United States Patent [19]

Hittel

[11] 4,263,791

[45] Apr. 28, 1981

[54] MOUNTING ARRANGEMENT FOR WARP KNITTING MACHINE ELEMENTS

[75] Inventor: Gerhard Hittel, Rodgau, Fed. Rep. of Germany

[73] Assignee: Karl Mayer Textil-Machinenfabrik GmbH, Obertshausen, Fed. Rep. of Germany

[21] Appl. No.: 101,038

[22] Filed: Dec. 6, 1979

[30] Foreign Application Priority Data

Dec. 14, 1978 [DE] Fed. Rep. of Germany ..... 2854030

[51] Int. Cl.[3] ..... D04B 15/06

[52] U.S. Cl. ..... 66/109

[58] Field of Search ..... 66/203, 104, 109

[56] References Cited

U.S. PATENT DOCUMENTS

| | | | |
|---|---|---|---|
| 2,014,529 | 9/1935 | Kinsella | 66/109 X |
| 3,289,438 | 12/1966 | Kohl | 66/109 |

*Primary Examiner*—Ronald Feldbaum

*Attorney, Agent, or Firm*—Omri M. Behr; Martin Sachs

[57] ABSTRACT

A mounting arrangement for warp knitting machine elements includes a means for absorbing forces generated during the course of knitting. These forces are transferred to at least two surfaces thereby reducing the size and weight requirements of the working elements permitting the warp knitting machine to operate at higher speeds.

7 Claims, 4 Drawing Figures

MOUNTING ARRANGEMENT FOR WARP KNITTING MACHINE ELEMENTS

BACKGROUND OF THE INVENTION

1. Field of the Invention

The present invention relates warp knitting machine elements, and in particular to a means for reducing the mass of the working elements while permitting them to absorb the necessary forces generated during knitting.

2. Description of the Relevant Art

Many of the working elements or components of a warp knitting machine such as needles, guides, knock-over sinkers, stitch comb sinkers, knock-over sinkers or the like are mounted in lead. An aperture provided in the lead portion of the element permits a bolt to be inserted therethrough. These screws or bolts grip by means of their enlarged head, the lead portion of the element and maintain it in position on the mounting bar. Generally, a plurality of elements are utilized and they run in a row parallel to the needle bed. During the knitting process substantial forces are generated which operate perpendicular to the plane of the mounting bar. These forces tend to lift the mounting from the bearing surface of the mounting bar. Since the forces generated must be absorbed by the screw and its enlarged head it is generally necessary that the bolt be provided with a relatively large diameter and thick head.

The leverage operating between the thread or goods and the bolts are comparatively large, therefore, the mounting itself must be formed in a manner that will resist bending. This is accomplished by either providing a substantially thick lead plate for one portion of the element or utilizing a stiffening device such as ribs alternatively an intermediate stiffening support plate between the head of the screw and the mounting surface may be utilized. All of these measures tend to increase the mass of the moving parts and thereby tend to limit the speed of operation of the warp knitting machine.

SUMMARY OF THE INVENTION

An object of the present invention is to reduce the size and mass of warp knitting machine elements in order to permit the machine to operate at faster speeds.

Another object of the present invention is to provide a means for absorbing the forces generated during knitting to more than one surface.

A further object of the present invention is to provide lightweight knitting elements which are capable of absorbing and transferring the forces occurring during knitting without being distorted thereby.

The present invention overcomes the shortcomings of prior art devices by providing a second bearing surface parallel to an opposite to the first bearing surface on the mounting bar which cooperate to absorb the thrust forces which occur during the knitting cycle thereby reducing the size and mass of the element.

Therefore, a warp knitting machine having a needle bar, a guidebar, a knock-over sinker bar, or the like, wherein in each said respective bar has a plurality of elements such as needles, guides, sinkers or the like mounted thereon, the improvement, according to the principles of the present invention, includes a novel mounting arrangement comprising the mounting bar being provided with at least two receiving surfaces, elements means in contact with both said force receiving surfaces and cooperating therewith with transferring forces applied to said element means to both said force receiving surfaces and means for removably retaining the element means to the mounting bar in a fixed position.

It is not necessary that the element means be in contact with both receiving surfaces when the machine is at rest and not subject to the thrust forces, thus a small clearance between one element surface and the receiving surface adjacent thereto is acceptable provided that when the machine is in operation the thrust forces cause contact to be achieved.

The foregoing and other objects and advantages will appear from the description to follow. In the description reference is made to the accompanying drawing which forms a part hereof, and on which is shown by way of illustration a specific embodiment in which the invention may be practiced. This embodiment will be described in sufficient detail to enable those skilled in the art to practice the invention, and it is to be understood that any other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
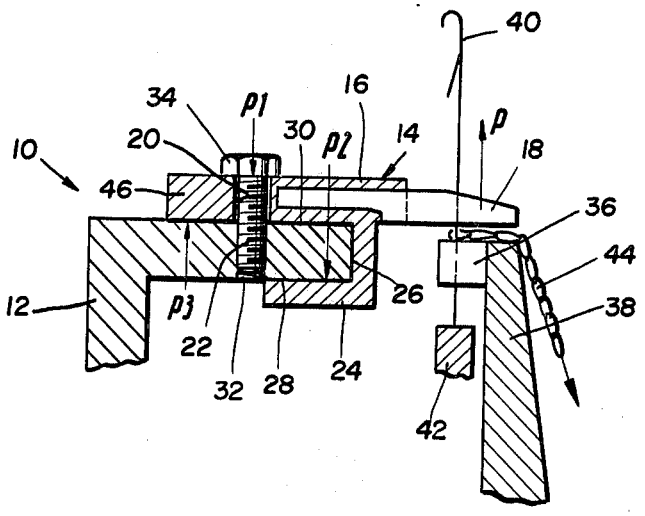
FIG. 1 is a cross-section of the working area of a warp knitting machine including the improvements according to the principles of the present invention.

Referring now to the figures and in particular to FIG. 1, which shows the working area 10 of a conventional warp knitting machine, not shown. The warp knitting machine has an angled mounting bar 12 with a working element such as a sinker 14 affixed thereon. The element 14 is preferably fabricated in two parts or portions 16 and 18. Generally, portion 16 is referred to as the mounting portion and portion 18 is referred to as the working component and in the figure disclosed the working component 18 is a sinker which has been soldered into the mounting portion 16. The mounting portion 16 is provided with an aperture 20 that is larger in diameter than the threaded screw or bolt 22 that must pass therethrough. A part 24 of the mounting portion 16 circumscribes the free edge 26 forwardly of bolt 22, of the angled mounting bar 12 and may be in contact with the undersurface 28 thereon. When element 14 is mounted on bar 12 a small clearance, say about 0.1 mm is permissable between under surface 28 and the upper surface of part 24. During the operation of the machine as described below the operating forces will provide a contact between the two surfaces.

Bolt 22 which has a threaded portion thereon is placed through aperture 20 in the mounting portion 16 and threadedly engaged into aperture 32 provided in the generally horizontal portion of the angled mounting bar 12. Thus, the head 34 on bolt 22 will retain the working element 14 in position on the mounting bar when the bolt is tightened into threaded aperture 32.

The working component 18 of element 14 cooperates with knock-over sinker 36 which is affixed to another mounting bar 38. Latch needle 40 is shown mounted in needle bar 42 which cooperates with the element 14 and the thread guides, not shown, to generate a ware 44.

Generally, the mounting portion 16 is cast from lead and it is cast with the working component 18 integral therewith.

In operation, a force in the direction of arrow P is generated in the liftoff direction on component 18 during the knitting process. The force P is counteracted by a force $P_1$ operating on screw or bolt 22. Prior art elements utilize only the strength of bolt 22 to absorb these forces and maintain the working element 14 in position. Element 14 had to be of sufficient strength to absorb these forces without distorting and causing malfunctions in the machine operation. As is presently disclosed, by utilizing a part 24 of the mounting portion 16 to extend beneath the angled mounting bar 12, but forward of bolt 22, forces act in the direction of $P_2$ simultaneously with the force acting at $P_1$ thereby dividing the strain placed upon the mounting portion 16. In the modification of this embodiment wherein in the at rest position surface 28 is not in contact with the upper surface of part 24, the operation of these forces causes the contact therebetween. The moment about $P_2$ caused by P is smaller than the force created about $P_1$ from P, thereby reducing the bending forces which appear on the mounting 16 and reducing the amount of force that must be absorbed by the bolt 22. The force $P_3$ acting on the end 46 of the mounting portion 16 is also reduced.

Figure 2:
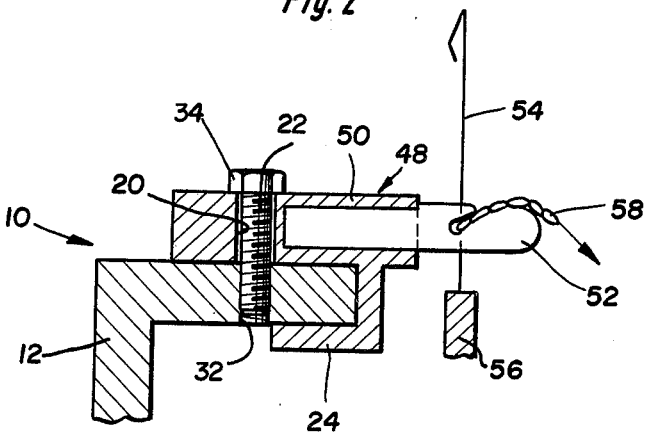
FIG. 2 is a similar cross-section of a warp knitting machine utilizing other elements.

The embodiment shown in FIG. 2 includes an angled mounting bar 12, a mounting bolt 22 used to retain the element 48 which includes a mounting portion 50 and a working component 52, e.g. a compound knock-over sinker. A bearded needle 54 affixed in the needle bar 56 cooperates with the knock-over sinker 52 to form the goods or ware 58, in a conventional manner. The construction of the mounting portion of the working element 48 is similar to that shown in FIG. 1 and is affixed to the mounting bar 12 in the same manner. It is also to be noted that the forces generated with the embodiment shown in FIG. 2 is exactly the same as that generated with respect to the element 14 shown in FIG. 1. Thus, utilizing this configuration would also reduce the forces necessary to be absorbed by the mounting portion 50 and the mounting bolt 22.

Figure 3:
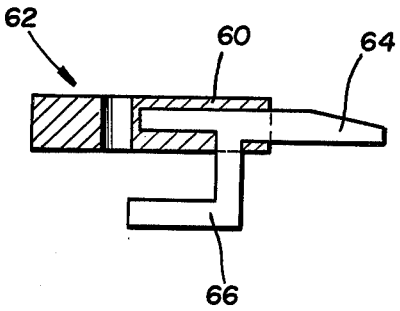
FIG. 3 is an alternate embodiment of an element according to the principles of the present invention.

In the embodiment shown in FIG. 3 the mounting portion 60 of the working element 62 includes a working component 64 molded therein. The component 64 as shown in FIG. 3 is known as a stitch comb or hold down sinker and is provided with an extending part 66 which is made to cooperate with the undersurface 28 of the angled mounting bar 12. Note here, however, that the mounting portion 60 does not include the extending portion 66, but instead, it is integral with the sinker element 64. This configuration will also divide the forces generated on the component 64 so that it will be transferred to the mounting bar 12, via the extending part 66, as well as through the mounting portion 60.

Utilizing the construction as set forth above, the forces tending to lift the elements from the bar are distributed between two surfaces as well as the retaining bolt. This reduces the loading on the bolt and the mounting surfaces so that they may be constructed thinner than heretofore. The leverage between the force creating the moments is reduced so that the mounting is subjected to less bending. Thus, the mounting itself can be constructed of thinner materials and no additional strengthening of reinforcement is needed to maintain the working element in alignment. As a result of this lighter construction it is possible to reduce the overall mass and thus increase the speed of operation of the warp knitting machine.

Figure 4:
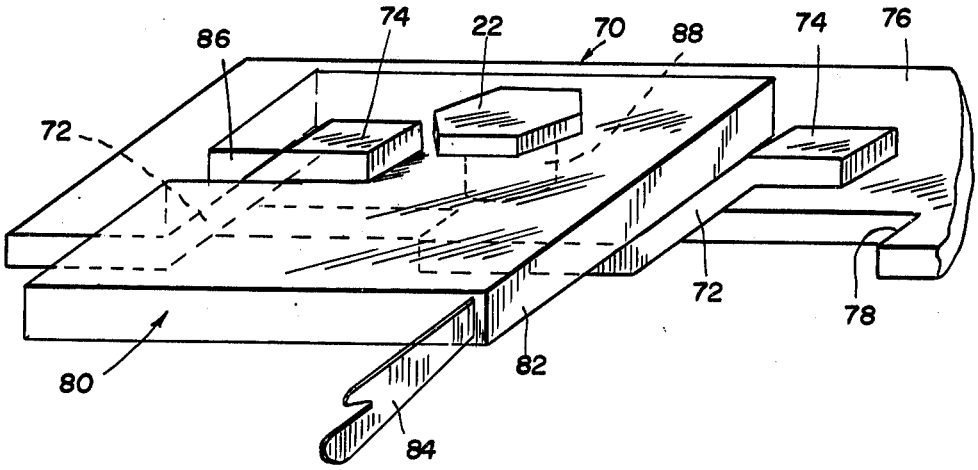
FIG. 4 is an enlarged pictorial representation of a modified mounting bar with an additional bearing surface being provided according to principles of the present invention.

In a further embodiment disclosed in FIG. 4, the mounting bar 70 is provided with an upwardly extending member 72 which terminates in a flat portion 74 that is essentially parallel to the upper surface 76 of the mounting bar 70. The upwardly extending member 72 is formed from the mounting bar 70 leaving an open space 78 in the mounting bar. A threaded aperture 78 is provided in the mounting bar 70 which is adapted to receive bolt 22 therein in the same manner as disclosed in the other embodiments.

The working element 80 incudes a mounting portion 82 and a working component 84 which is shown herein as a compound knock-over sinker. The mounting portion 82 is provided with an elongated rectangular opening 86 adapted to cooperate with the upwardly extending member 72 and receive it snugly therein. The thickness of the mounting portion 82 is chosen so that it snugly fits beneath the undersurface of flat portion 74 and extends approximately up to the next upwardly extending member provided in the upper surface 76 of mounting bar 70. In this embodiment, as in that of FIG. 1, a small clearance in the "at rest" position is permissable between the under surface of that portion 74 and the upper surface of mounting portion 82. An aperture is provided in mounting portion 82 and is positioned to coincide with the aperture 88 provided in the mounting bar 70. By inserting the threaded bolt 22 into threaded aperture 88 and tightening it down mounting portion 82 will be held firmly in place. Obviously, the forces which may occur on working component 84 will be divided between the underside of flat portion 74, the surface 76 and bolt 22. Thus, here again there are at least two force receiving surfaces capable of receiving and sharing forces generated on working component 84 during the normal knitting of goods. The construction as set forth will also permit the reduction of weight of the working element since the forces have been more equally divided throughout.

Hereinbefore has been disclosed a means for constructing a working element having a reduced weight without sacrificing strength and rigidity permitting the working speed of a warp knitting machine to be increased. It will be understood that various changes in the details, materials, arrangement of parts and operating conditions which have been herein described and illustrated in order to explain the nature of the invention may be made by those skilled in the art within the principles and scope of the present invention.

Having thus set forth the nature of the invention what is claimed is:

1. In a warp knitting machine having a needle bar, a guidebar, a knock-over sinker bar, or the like, wherein each said respective bar has a plurality of elements such as needles, guides, sinkers, or the like mounted thereon, the improvement in the mounting arrangement comprising:

(a) at least one of said mounting bars being provided with at least two force receiving surfaces;

(b) element means contactable with both said force receiving surfaces and cooperating therewith for transferring forces applied to said element means to both said force receiving surfaces; and (c) means for removably retaining said element means to said mounting bar in a fixed position.

2. A mounting arrangement according to claim 1 wherein said element means generate said forces during the course of knitting each said element means including two portions, one element force receiving surface being included in each portion.

3. A mounting arrangement according to claim 1 wherein said element means generate said forces during the course of knitting, each said element means including two portions, one of said portions including both said force receiving surfaces.

4. A mounting arrangement according to claim 1 wherein said mounting bar is provided with one force receiving surface being spaced apart from the other force receiving surface said element means being received therebetween.

5. A mounting arrangement according to claim 1 wherein said mounting bar is further provided with a threaded aperture having an axis perpendicular to at least one of said force receiving surfaces and said removable retaining means is a bolt having threads on the end thereof adapted to cooperate with the threads of said aperture, said element means being provided with an aperture, said bolt piercing said element aperture with the head thereof retaining said element means in alignment.

6. A mounting arrangement according to claim 2 wherein said element means portions are dissimilar materials.

7. A mounting arrangement according to claim 2 wherein said element means portions are different metals.

* * * * *